US008662777B2

(12) United States Patent
Thiebaut

(10) Patent No.: US 8,662,777 B2
(45) Date of Patent: Mar. 4, 2014

(54) PACKAGING ITEM FOR COSMETIC PRODUCT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 696 days.

(21) Appl. No.: 12/488,225

(22) Filed: Jun. 19, 2009

(65) Prior Publication Data

US 2009/0317170 A1 Dec. 24, 2009

Related U.S. Application Data

(60) Provisional application No. 61/080,556, filed on Jul. 14, 2008.

(30) Foreign Application Priority Data

Jun. 20, 2008 (FR) ..... 08 03464

(51) Int. Cl.
*A46B 17/08* (2006.01)

(52) U.S. Cl.
USPC ..... 401/122; 401/121

(58) Field of Classification Search
USPC ..... 401/118, 121, 122, 126–130, 193, 131; 132/317, 318; 206/15.3, 15.2, 362, 206/362.3
See application file for complete search history.

(56) References Cited

U.S. PATENT DOCUMENTS

| | | | | | |
|---|---|---|---|---|---|
| 402,679 | A * | 5/1889 | Leggett | 206/15.3 |
| 4,533,044 | A * | 8/1985 | Ban | 206/15.3 |
| 5,363,870 | A * | 11/1994 | Doyon | 134/184 |
| 5,700,100 | A | 12/1997 | Ackermann | |
| 6,024,507 | A * | 2/2000 | Joulia | 401/4 |
| 6,041,919 | A * | 3/2000 | Adams | 206/15.3 |
| 7,090,072 | B1 * | 8/2006 | Elliott | 206/15.3 |
| 7,686,528 | B2 * | 3/2010 | Gueret | 401/129 |

FOREIGN PATENT DOCUMENTS

| | | |
|---|---|---|
| FR | 07/57116 | 2/2009 |
| JP | 09-094115 | 4/1997 |
| JP | 2005-080730 | 3/2005 |

* cited by examiner

*Primary Examiner* — David J. Walczak
*Assistant Examiner* — Jennifer C Chiang
(74) *Attorney, Agent, or Firm* — Oblon, Spivak, McClelland, Maier & Neustadt, L.L.P.

(57) ABSTRACT

A packaging item for a product includes a receptacle with a wide opening at which is mounted a plate carrying at least two wiping members. The plate is movably mounted on the receptacle so that each wiping member can occupy different positions in the opening of the receptacle. The positions allow product to be removed with an applicator from the different zones of the receptacle.

14 Claims, 5 Drawing Sheets

PACKAGING ITEM FOR COSMETIC PRODUCT

CROSS-REFERENCE TO RELATED APPLICATIONS

This application claims the benefit of priority from French patent application no. FR 08/03464, filed on Jun. 20, 2008, and U.S. provisional application No. 61/080,556, filed on Jul. 14, 2008, the entire contents of each of which are hereby incorporated herein by reference.

BACKGROUND OF THE INVENTION

1. Field of the Invention

The present invention relates to a packaging item. One example relates to a packaging item for a cosmetic product, and to a method for using the packaging item.

In the present application, the term "cosmetic product" means a product as defined in Council Directive 93/35/CEE dated Jun. 14, 1993.

2. Description of Related Art

Typically, a packaging item for a cosmetic product comprises a receptacle having an opening for distribution of a cosmetic product. The width of such an opening depends in particular on the characteristics of the cosmetic product. In the case in which the cosmetic product is in the form of a mousse, for example, the opening of the receptacle via which the receptacle is filled is relatively wide so that the structure of the mousse is not modified on filling. Such a receptacle is generally wider than it height.

French patent application FR 07/57116 describes equipping a wide opening receptacle with a plurality of wiping means, each wiping means defining an orifice through which an applicator can pass to remove a quantity of product from the receptacle. The wiping means are supported on a plate which is fixedly mounted on the receptacle and which closes the opening of the receptacle. That plate comprises a large number of wiping means distributed in a manner which allows the cosmetic product to be removed from any point of the receptacle using the applicator. The consumer using the receptacle has to select a wiping means via which the product can be removed, then pass the applicator through that means.

However, it has been observed that consumers may be confused by the large number of wiping means on the plate and do not know which one to use. It can be difficult or even impossible to see, through the orifices for passage of the wiping means, the regions in the receptacle where sufficient product remains. Further, for cost and simplicity reasons, the plate and the wiping means are formed from a single piece. However, the plate is preferably relatively rigid and the wiping means are preferably more flexible, which complicates the choice of the material for the part. It would be possible to produce that part from two materials, but this would result in a part which was more complex and more expensive to produce.

JP-A-2005080730 describes a receptacle comprising a body on which a wiping means comprising a multitude of holes through which the teeth of an applicator can pass is movably mounted in rotation. The wiping means is driven in rotation by means of the applicator. Displacement of the applicator in the receptacle causes deposition of the product contained in the receptacle onto its teeth. However, all of the teeth of the applicator are engaged simultaneously in the holes of the wiping means to remove product from several different regions in the receptacle. These holes are distributed over the whole extent of the opening of the receptacle, which thus results in removal of product from all of the zones of the receptacle. Thus, when using that device it is difficult or impossible to select a particular and unique zone for removing product from the receptacle.

Further, JP-A-09094115 describes a receptacle comprising means for adjusting the quantity of product removed with an applicator, the adjustment means comprising a means which is movable in rotation and comprising several orifices with different diameters through which the applicator can pass. However, the applicator normally removes product from the receptacle from the same zone. Thus, with that device it is not typical to remove product from different zones of the receptacle.

SUMMARY OF THE INVENTION

The various examples of the invention discussed below aim to provide a relatively simple, effective, and economical solution to the disadvantages of the conventional devices.

One example of the invention provides a packaging item, in particular for a cosmetic product, comprising a receptacle provided with an opening and a plate extending at the opening of the receptacle and carrying at least two wiping means through one of which an applicator can pass to remove product from the receptacle. The plate is typically movably mounted on the receptacle such that at least two wiping means, i.e., wipers or wiping members, can occupy different positions in the opening of the receptacle. The positions typically allow product to be removed with the applicator from different zones of the receptacle.

One example of the invention provides a packaging item with a receptacle which is of the wide opening type. In the present application, the term "wide opening" of a receptacle means an opening the diameter or transverse dimension of which is substantially equal to the internal diameter or the transverse dimension of the receptacle, or more generally may be in the range from approximately 70% to 100% of the diameter or the transverse dimension. A wide opening of a receptacle may have a section in the range 25 to 400 times the cross-section of the shaft of an applicator intended to be used with this receptacle. The receptacle opening may be circular or non-circular in shape, for example polygonal.

In the packaging item of the invention, displacement of the plate on the receptacle or relative to the receptacle means that the wiping means can be brought into a plurality of positions above the product contained in the receptacle. A single wiping means can thus be used to remove product from a plurality of zones in the receptacle, and not from just a single zone as in conventional devices. The number of wipers may be considerably reduced and is, for example, in the range two to ten, preferably in the range three to six, as opposed to up to 60 in the conventional devices. These wiping means are typically substantially parallel to each other and may be at a distance from or close to each other.

The wiping means may be produced from materials which are different from each other. As an example, in the case in which the plate carries two wiping means, one of the means may be produced from a relatively elastically deformably material and the other of these means may be produced from a relatively rigid material. Further, the wiping means may have structures and/or configurations which differ from each other. As an example, one of the wiping means may comprise a longitudinal slot, while the other wiping means are not provided with such a slot.

The consumer of the packaging item of the invention thus has reduced difficulty in selecting one of the wiping means of the plate. The small number of wiping means also means that the zones in the receptacle where there is product and the quantity of product in these zones can be better discerned. The consumer can also see the product in the receptacle through the plate if this is formed from a transparent or translucent plastic material, or directly through the opening of the receptacle if the plate does not cover the whole of the opening. Further, the small number of wiping means means that they can be manufactured independently of the plate, and so the means could be produced from an appropriate material then attached to and fixed on the plate.

In accordance with another example of the invention, the plate is movable in a plane which is substantially perpendicular to the axis of the opening of the receptacle. In the present application, the term "axis of the opening of the receptacle" means an axis which extends in the direction of the opening of the receptacle, i.e., its product distribution opening. This axis preferably passes through the center of this opening and may be a longitudinal axis of the receptacle. The axis of the opening may be secant, in particular orthogonal, to a transverse plane of the receptacle or to a plane passing through the free border of a neck of the receptacle.

The displacement of the plate on the receptacle may cause a displacement in translation and/or rotation of the wiping means in the opening of the receptacle. Advantageously, the trajectories of the displacement of the wiping means in the opening of the receptacle are non secant, i.e., they do not cut each other. In other words, each wiping means can adopt a position in the opening of the receptacle that the other wiping means cannot adopt. These trajectories may be circular, curvilinear, or rectilinear.

In one embodiment of the invention, the plate is movable in rotation on the receptacle about an axis which is parallel to the opening of the receptacle or identical with this axis. In the case in which the receptacle forms a drum extending about an axis of revolution, the plate is preferably movable in rotation about the axis of revolution.

The wiping means are thus preferably at different radial distances from the axis of rotation of the plate. At least one of the wiping means may be situated at a zero radial distance from this axis and may thus be situated at this axis in order to remove product with the applicator at the center of the receptacle. The other means are at a distance from the axis of rotation of the plate and are displaceable on different circumferences centered on this axis of rotation. The axis of rotation of the plate may be the axis of the opening of the receptacle or the axis of the receptacle.

Advantageously, the sum of the dimensions in the transverse direction of the wiping means typically represents between approximately 30% and 100%, preferably between approximately 45% and 50% of the dimension in the transverse direction of the opening of the receptacle. As an example, when the opening of the receptacle is generally circular in shape, the sum of the cross-sectional dimensions of the wiping means represents at least 75%, preferably at least 90%, more preferably approximately 100% of the radius of the opening, and at most the diameter of the opening.

The plate may comprise an annular rim surrounding a neck of the receptacle and comprising an inner annular bead which is engaged by elastic snap-fitting into an outer annular groove of the neck of the receptacle and which can slide in the groove.

In another example of the invention, the plate is displaceable in translation on the receptacle.

The plate may comprise two lateral parallel opposed rims comprising pins which face each other, which are engaged by elastic snap-fitting in grooves on a neck of the receptacle and which can slide in the grooves.

The plate may have a circular, square, rectangular or other outer contour. It covers part or all of the receptacle opening. It may be produced from a transparent or translucent material so that a consumer can see regions of the receptacle where cosmetic product remains through the plate.

In the case in which the receptacle contains several products, partitions separating these various products may be provided in the receptacle. Each wiping means typically can be used to remove one or more types of products contained in the receptacle.

Another example of the invention includes a kit comprising a packaging item of the type cited above and at least one applicator, and preferably two applicators of different natures and/or forms. By way of example, in the case in which the receptacle contains several different products, the kit may comprise a mascara applicator, a lip gloss applicator (for example of the flocked tip type) and/or an applicator for nail polish (for example of the paintbrush type). In the case in which the receptacle contains a single product, the kit may comprise an applicator of the bristled brush type, an elastomer brush and/or a comb with injection molded teeth.

Another example of the invention provides a method for using the packaging item described above. The method typically includes the following steps: displacing the plate over the receptacle until a wiping means to be used is in a desired position over the product contained in the receptacle; then introducing an applicator into the wiping means in order to remove product from the receptacle; and removing the applicator from the wiping means.

Another example of the invention provides a packaging item for a product. The product can be a cosmetic product. The packaging item includes a receptacle including an opening. A plate extends along the opening of the receptacle and supports a plurality of wiping members at least one of which wiping members is configured to permit passage of an applicator to remove the product from the receptacle. The plate is movably mounted on the receptacle such that at least two wiping members of the plurality of wiping members are configured to occupy different positions in the opening of the receptacle, the positions allowing the product to be removed with the applicator from different zones of the receptacle.

Another example of the invention provides a method of removing a product from a receptacle. The method includes providing a receptacle including an opening; providing a plate extending along the opening of the receptacle and supporting a plurality of wiping members at least one of which wiping members is configured to permit passage of an applicator to remove the product from the receptacle. The method further includes movably mounting the plate on the receptacle such that at least two wiping members of the plurality of wiping members are configured to occupy different positions in the opening of the receptacle, the positions allowing the product to be removed with the applicator from different zones of the receptacle. The method further includes displacing the plate over the receptacle until at least one wiping member to be used is positioned over a zone for removing the product; inserting an applicator into the wiping member positioned over the zone in order to remove the product from the receptacle; and removing the applicator from the wiping member into which the applicator was inserted.

Another example of the invention provides a packaging item for a cosmetic product. The packaging item includes a receptacle including an opening. A plate extends along the opening of the receptacle and supports a plurality of wiping members at least one of which wiping members is configured to permit passage of an applicator to remove the product from the receptacle. The packaging item includes means for moving at least two wiping members of the plurality of wiping members to occupy different positions in the opening of the receptacle, the positions allowing the product to be removed with the applicator from different zones of the receptacle.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood and other details, characteristics, and advantages of the present invention will become more apparent from the following description made by way of non-limiting examples made with reference to the accompanying drawings, in which.

DETAILED DESCRIPTION OF THE PREFERRED EMBODIMENTS

Figure 1:
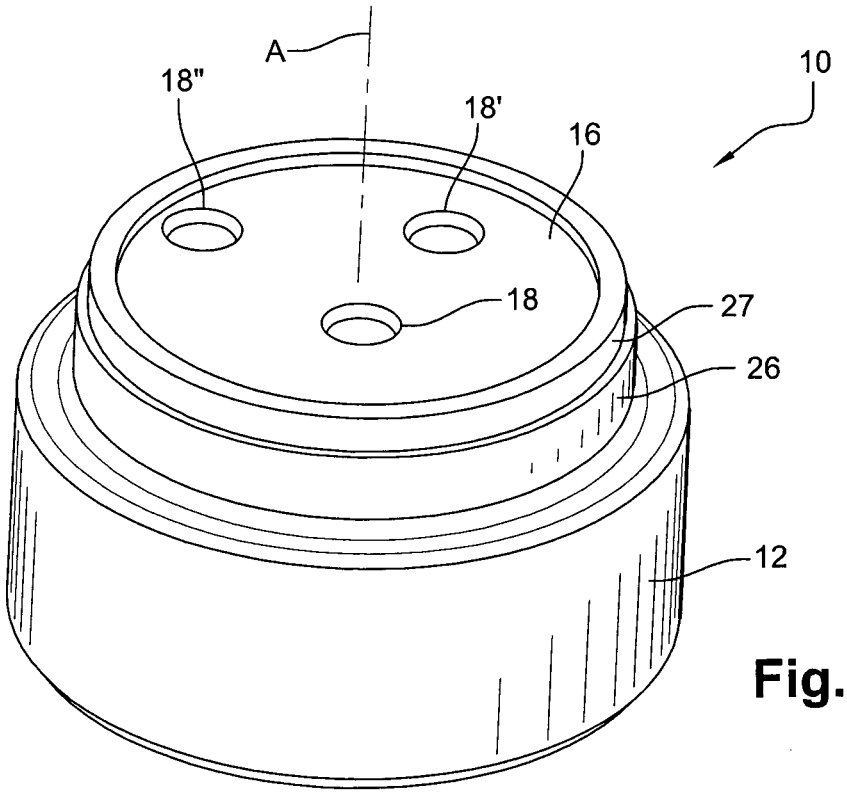
FIG. 1 is a diagrammatic perspective view of a packaging item according to one example of the invention.

Referring now to the drawings, like reference numerals are utilized to designate identical or corresponding parts throughout the several views.

Initially, reference will be made to FIGS. 1 to 3 which show a packaging item 10 for a cosmetic product of one example of the invention. The packaging item 10 includes a receptacle 12 containing the cosmetic product 14 and a plate 16 which is movably mounted on the receptacle 12 and which carries wiping members 18, 18', 18" through which an applicator 20 can pass to remove a quantity of product contained in the receptacle.

The receptacle 12 comprises at its upper end a neck 22 defining an opening 24 for distribution of product and including an external thread 26 for screwing on a lid (not shown) for sealing the receptacle closed.

In the example shown, which is not in any way limiting, the receptacle 12 is generally cylindrical in shape and is of the wide neck 22 type or wide opening 24 type. The diameter or the transverse dimension of the depicted opening 24 is substantially identical to the internal diameter or to the transverse dimension of the receptacle 12. The diameter of the opening 24 is, for example, in the range from approximately 20 to 100 mm. The opening 24 here acts both for filling the receptacle and for distribution of the cosmetic product.

An axis A can be defined as the axis of opening 24 of the receptacle, this axis passing through the center of the opening and being identical with the longitudinal axis of the receptacle 12 in the example shown. The opening 24 here has a circular cross-section.

The cosmetic product 14 may be, for example, a makeup product selected from a mascara, a foundation, a nail polish, a concealer, an eyeliner, a gloss, a lipstick, a blusher, an eyeshadow, etc. This product, for example, typically has a viscous consistency, such as a gel, cream, oil, mousse, wax, paste, etc. This product may also be a skin care product such as an anti-wrinkle or concealing preparation or a skin treatment product.

The plate 16 is typically formed as a disk which covers the whole of the opening 24. It is removably mounted on the receptacle 12 and includes at its outer periphery an annular rim 27, which extends to the side of the receptacle 12 and which is engaged on an upper end portion of the neck 22 of the receptacle. This rim 27 may have an inner annular rim 28 which is engaged in an outer annular groove 30 of the neck of the receptacle by elastic snap-fitting. The plate 16 is typically displaceable in rotation on the receptacle about the axis A by sliding the bead 28 in the groove 30 of the neck.

The plate 16 is preferably, for example, produced from a transparent or translucent material so that a consumer can see the product contained in the receptacle through the plate and can locate a zone in the receptacle from which product can be removed.

The applicator 20 includes, for example, a handle which is fixed to one end of a shaft the other end of which carries an appropriate rigid or flexible tip such as an injection molded or twisted core brush, a paintbrush, a spatula, a comb, an open and/or closed cell foam, a flocked or bristled tip, etc. In one example, the shaft of the applicator 20 may be substantially cylindrical and have an external diameter of approximately 5 mm. The applicator is, for example, typically of the type described in application FR 07/57116. The product may be removed by rotating the tip one or more times when it is in contact with the product or immersed therein, or by pumping, i.e., with small to-and-fro movements of the tip in the product.

The wiping members 18, 18', 18" have a generally tubular shape and comprise at each of their lower ends a constriction defining an orifice 32 for passage of the applicator 20. The smaller this orifice 32, the smaller is the quantity of product removed by the applicator after removing it from the wiping means. The diameter of the orifice 32 can vary from one wiping member to another and is, for example, in the range 0.05 to 0.5 times the diameter of the opening 24 of the receptacle.

In the example shown, the wiping members 18, 18', 18" are identical and extend substantially parallel to each other and to the axis A in the opening of the receptacle, i.e., in the space defined by the neck 22 of the receptacle. The wiping members total three in number in this example and are located at radial distances R1, R2, and R3 from the axis A, which differ from each other. They are also separated from each other by an angle of approximately 120° about the axis A in this example.

The wiping member 18, which is at a radial distance R1 which is closest to the axis A, is displaceable over a circumference C1 centered on the axis A. The wiping member 18 may be displaced into any position on this circumference C1 such that the applicator 20 can remove product from any point of the receptacle located on this circumference. In the same manner, the wiping member 18' and 18" which are respectively at radial distances R2 and R3 from the axis A are displaceable in rotation on the circumferences C2 and C3 centered on axis A.

The wiping members 18, 18', 18" allow product to be removed from adjacent concentric annular zones, the annular zone swept by the means 18" being situated outside the annular zone swept by the means 18' which itself is outside the annular zone swept by the means 18. These annular zones may or may not partially overlap.

Figure 2:
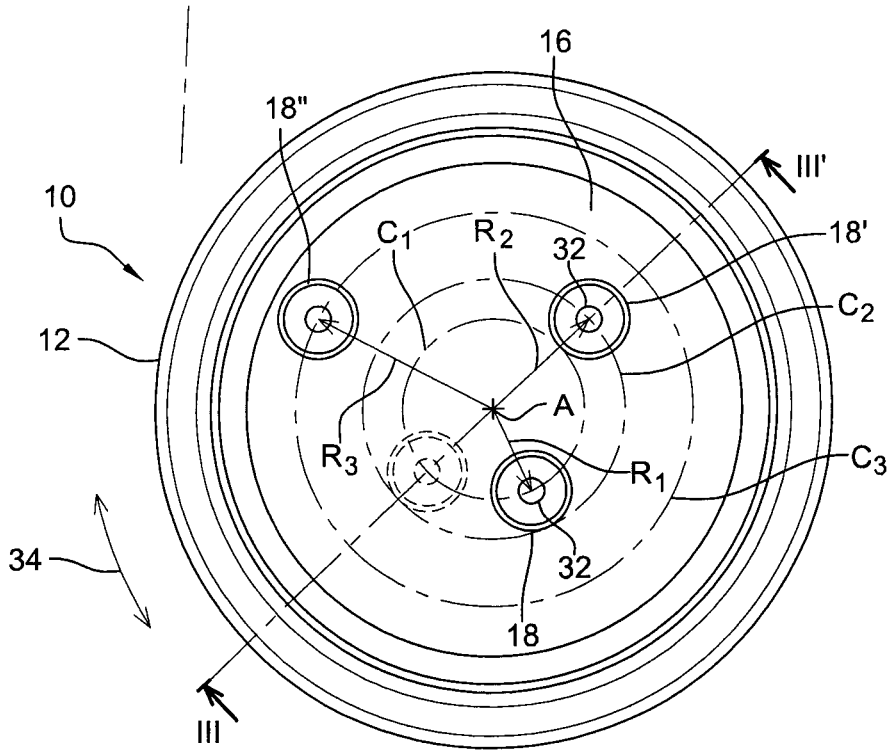
FIG. 2 is a diagrammatic top view of the packaging item of FIG. 1.
Figure 3:
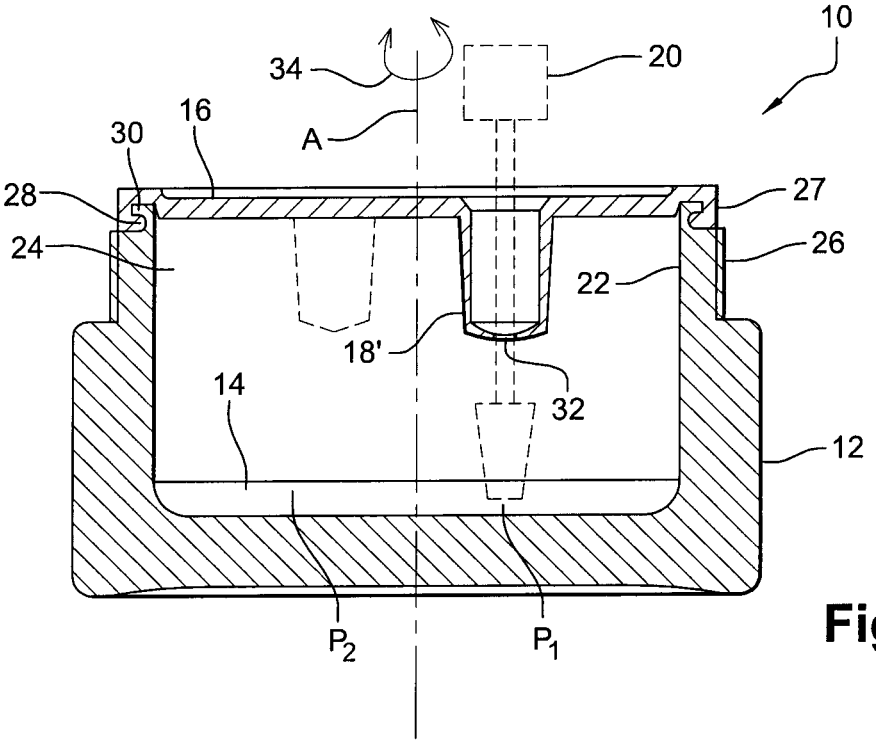
FIG. 3 is sectional view along line III-III' of FIG. 2.

The packaging item 10 shown in FIGS. 1 to 3 is used as follows: the consumer selects a zone for removing product (especially as a function of the quantity of product remaining in that zone) and then displaces the plate 16 in rotation about the axis A one or more times in the clockwise and/or anticlockwise direction (arrows 34) to bring a wiping means 18, 18', 18" over the selected zone. In the case of FIGS. 2 and 3, the wiping means 18' is placed over a withdrawal zone P1. The consumer then holds the plate 16 firmly on the receptacle to retain the position of the wiping member 18' in the opening 24, then introduces the applicator 20 into this wiping member to remove product from the zone P1. When withdrawing the applicator, the applicator tip is wiped by the constriction of the wiping member 18', which removes any surplus product being withdrawn. If desired, the consumer can then again displace the plate 16 in rotation on the receptacle 12 until the wiping member 18' is in another position (shown in the broken lines) on the circumference C2, this position of the wiping member 18' corresponding to a withdrawal zone P2 in the receptacle.

Figure 4:
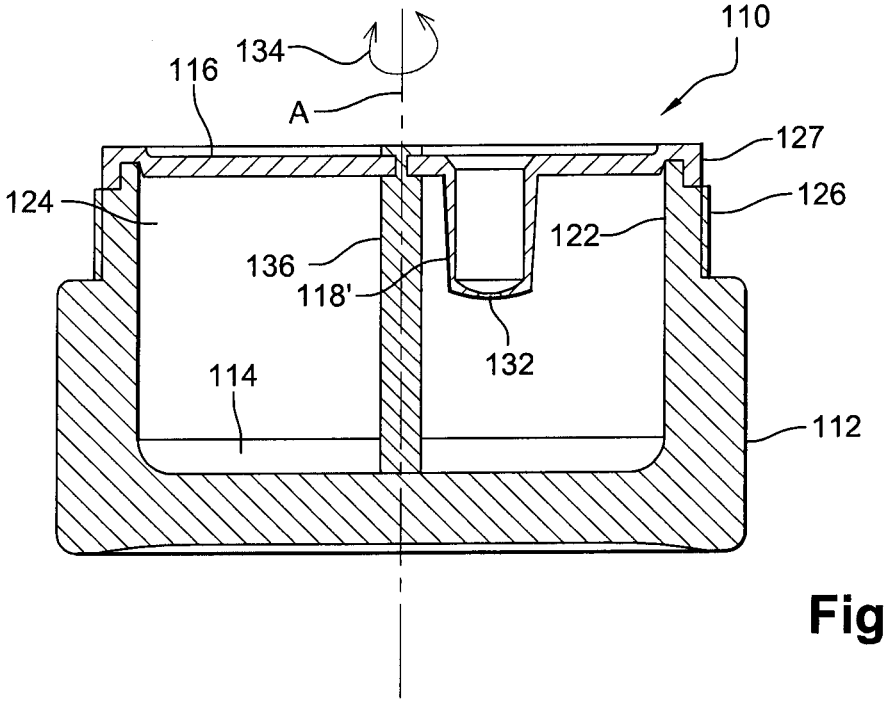
FIG. 4 is a view corresponding to FIG. 3 and represents a variation of an embodiment of the packaging item.

In the example shown in FIG. 4, the packaging item 110 differs from that described above in that the plate 116 is movably mounted in rotation on the receptacle 112 via a central strut 136 housed inside the receptacle. This strut 136 extends along the axis A, its lower end being firmly attached to the base of the receptacle 112 and its upper end forming a friction bearing engaged in a central orifice of the plate 116.

The plate 116 comprises an annular rim 127 which extends from the side of the receptacle and which surrounds an upper end portion of the neck 122 of the receptacle.

The other elements of the packaging item 110 which have already been described with reference to FIGS. 1 to 3 are referenced by the same numerals increased by at least one hundred. This numbering principle is repeated in the descriptions of the other variations which are below.

Figure 5:
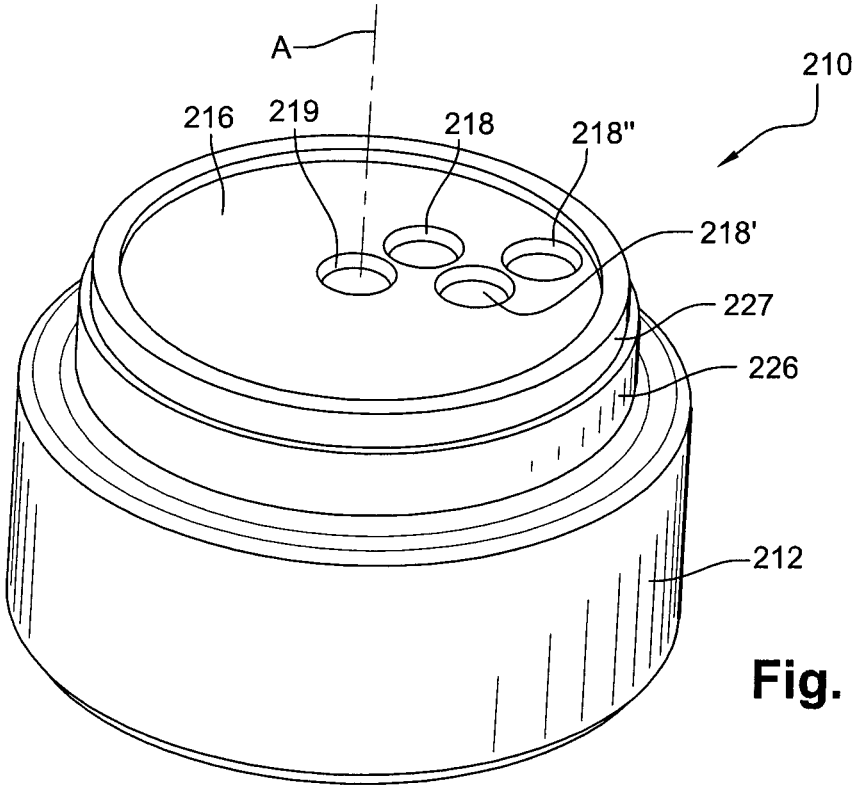
FIG. 5 is a diagrammatic perspective view of another variation of the packaging item.
Figure 6:
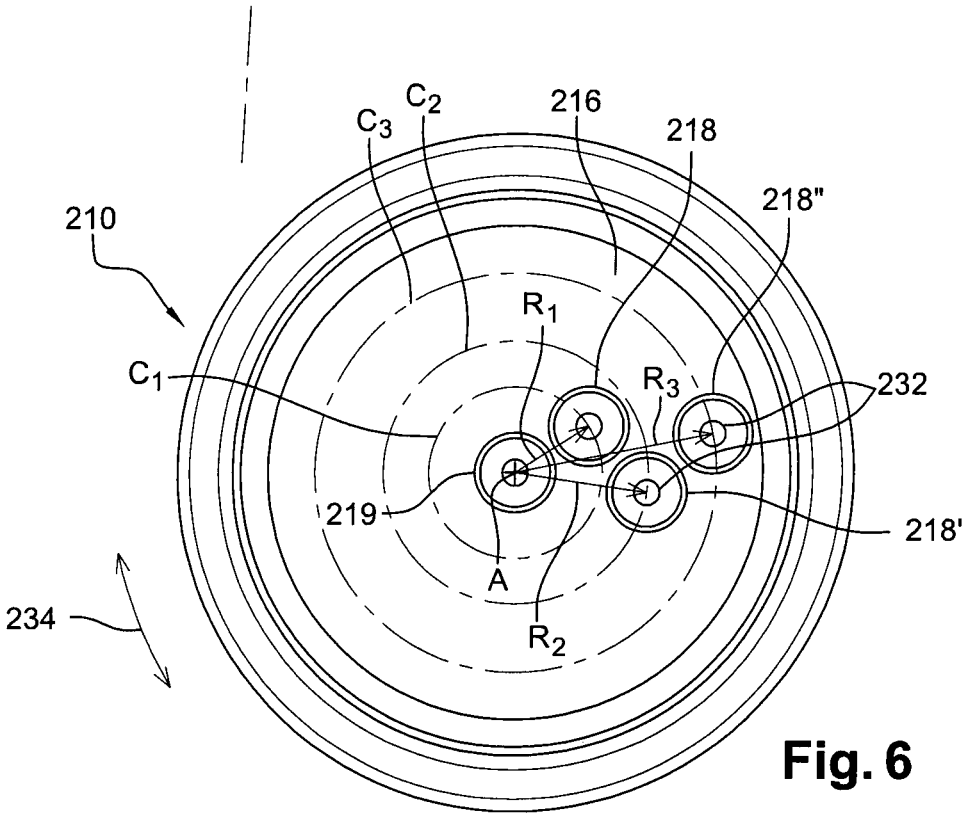
FIG. 6 is highly diagrammatic top view of the packaging item of FIG. 5.

The packaging item 210 shown in FIGS. 5 and 6 differ from that of FIGS. 1 to 3 in that the wiping members 218, 218', 218" and 219 carried by the plate 216 are four in number: a central wiping member 219 aligned on the axis A of the opening of the receptacle, and three wiping members 218, 218' and 218" disposed on the circumferences C1, C2, and C3 cited above, respectively. The three wiping members 218, 218', 218" are grouped on the plate in an angular sector of about 45° about the axis A in this example.

In the example shown, the radius R2 between the wiping member 219 and 218' is less than four times the radius of a wiping member, and the radius R3 between the wiping members 219 and 218" is less than six times the radius of a wiping member. Thus, these radii are typically not sufficient to allow the wiping means to be aligned on the same radius of axis A. The wiping members 218, 218', 218", and 219 in this example are disposed substantially in a diamond pattern, the means 218 and 218" and the wiping members 219 and 218' extending respectively in planes which are parallel to each other and to the axis A.

In a variation, the radii R2 and R3 cited above are sufficiently large to allow the wiping members 218, 218', 218", and 219 to be aligned on the same radius of the axis A.

The function of the packaging item 210 is similar to that of the packaging item 10. The wiping members 218, 218', 218" may be displaced into any position on their respective circumferences. The wiping member 219, which is aligned with the axis A of rotation of the plate 216, still retains the same position in the opening of the receptacle 212.

Figure 7:
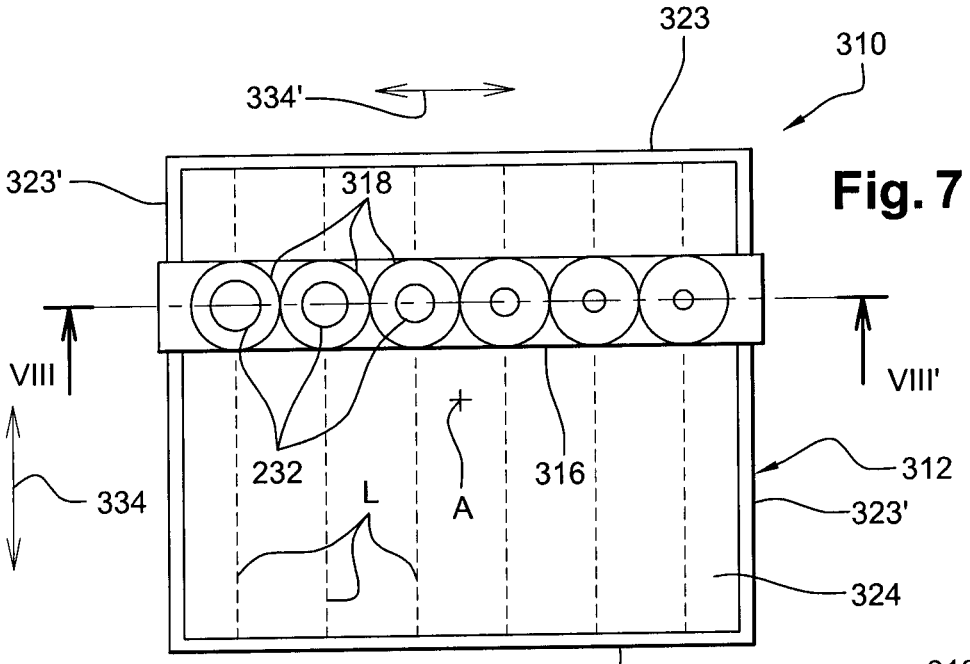
FIG. 7 is an diagrammatic top view of another variation of the packaging item.
Figure 8:
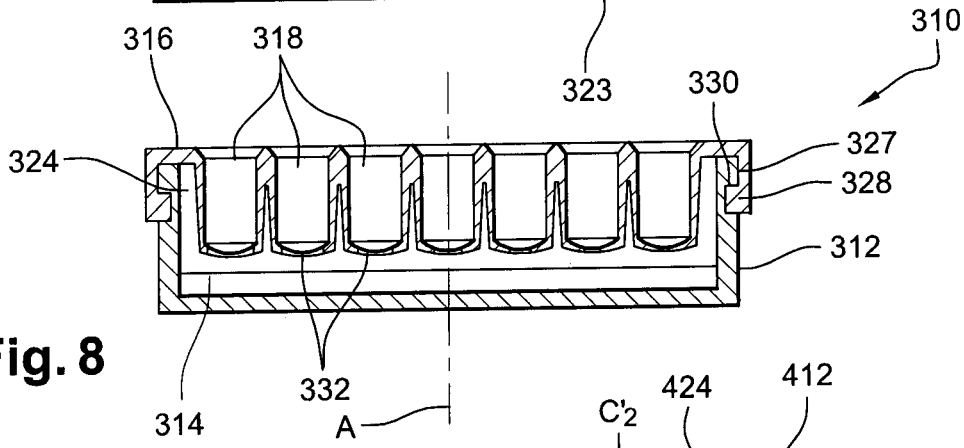
FIG. 8 is a sectional view along line VIII-VIII' of FIG. 7.

Reference will now be made to FIGS. 7 and 8 which represent another example of the packaging item of the invention.

This packaging item 310 a receptacle 312 which is generally parallelepipedal in shape and comprising an opening 324 with a substantially polygonal shaped cross-section, in particular substantially square or rectangular, and a plate 316 with a generally elongate shape.

The plate 316 is mounted on the receptacle 312 and covers only a portion of the opening 324 the axis of which is again designated by the letter A. The consumer can thus readily see the product in the receptacle through the opening 324.

The plate 316 has an elongate shape and extends parallel to two opposed side walls 323 of the receptacle. The plate 316 includes, at its longitudinal ends, two side rims 327, which cover the other two side walls 323' of the receptacle. The plate 316 includes pins 328 engaged in outer grooves 330 of the side walls 323'. The plate 316 is displaceable in translation on the receptacle 312 in a direction parallel to the walls 323' (arrows 334) by sliding the pins 328 in the grooves 330 from a position where it is situated in the immediate vicinity of one wall 323 of the receptacle to a position where it is located in the immediate vicinity of the other wall 323 of the receptacle. The plate 316 may be displaced into any intermediate position between these two extreme positions, as can be seen in FIG. 7.

The plate is preferably attached in a removable manner on the receptacle 312 by elastic snap-fitting of its pins 328 into the grooves 330 of the lateral walls 323' of the receptacle. The other lateral walls 323 of the receptacle preferably also include grooves 323 so that the plate 316 can be fixed either on the walls 323 or on the walls 323' when the receptacle is square in shape. When the plate 316 is fixed on the walls 323, it is displaceable in translation in a direction parallel to these walls 323 (arrows 334').

The plate 316 in this case carries six wiping members 318 which are substantially adjacent and disposed along the longitudinal axis of the plate. The orifices 332 of these members have different dimensions with respect to each other in order to wipe the tip of the applicator to a greater or lesser extent during withdrawal from a means, the applicator being of the same type as that described above.

During displacement in translation of the plate 316 along the walls 323', each wiping member 318 is displaced in translation along a line L in the opening 324 of the receptacle. The lines L are typically equidistant from each other and are distributed over the whole of the cross-section of the opening to allow product 314 to be removed from any zone of the receptacle using the applicator.

The receptacle 312 may also include a device that movably attaches a lid for sealing the receptacle closed.

Figure 9:
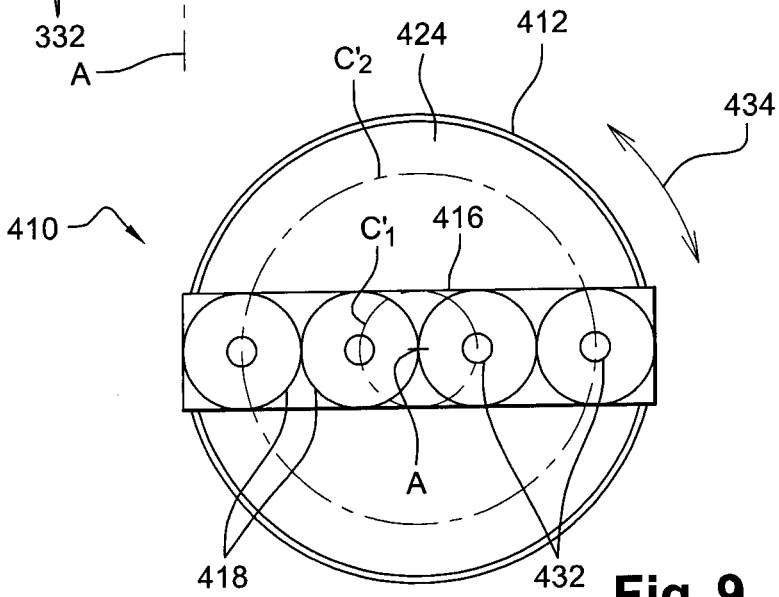
FIG. 9 is a highly diagrammatic top view of another variation of a packaging item.

In the variation shown in FIG. 9, the receptacle 412 is similar to that of FIGS. 1 to 3 and the plate 416 is similar to that of FIGS. 7 and 8, the plate including, at its longitudinal ends, pins or annular bead portions slidably engaged in an outer annular groove of the neck of the receptacle 412, so that the plate is displaceable in rotation on the receptacle about the axis A of the opening of the receptacle (arrows 434).

The wiping members 418 carried by the plate 416 total four in number in this example. They are adjacent and aligned along the longitudinal axis of the plate, two of the wiping members being situated on one side of the axis of rotation A and the other two wiping members being situated on the other side of the axis. The two wiping members situated close to the axis A are typically displaceable in rotation on the same circumference C1' centered on the axis A. The two wiping members situated at a distance from the axis A are displaceable in rotation on the same circumference C2' centered on the axis and situated outside the circumference C1'.

Figure 10:
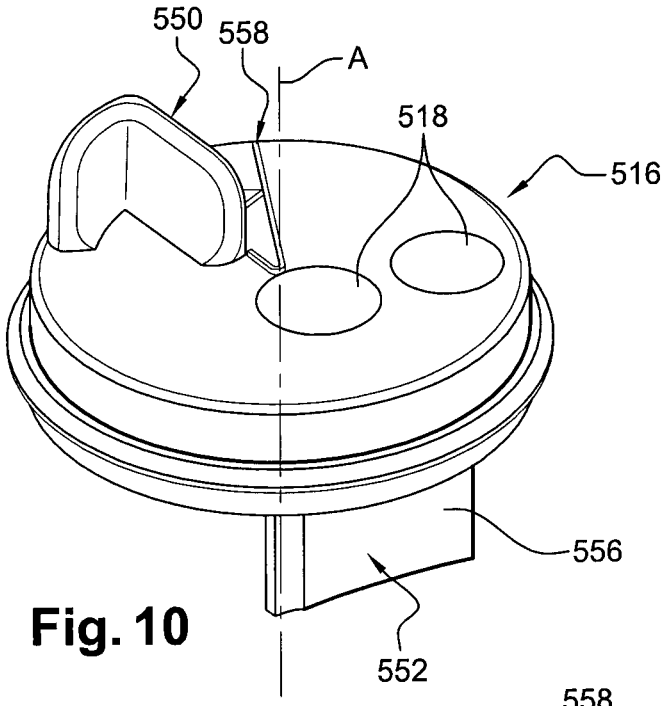
FIG. 10 is a perspective diagrammatic view of the plate of another variation of an embodiment of the packaging item.
Figure 11:
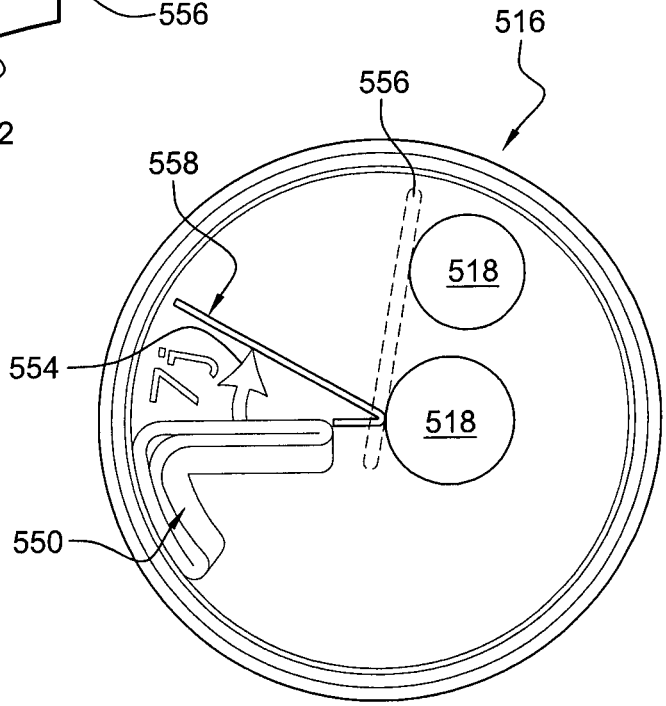
FIG. 11 is a diagrammatic top view of the plate of FIG. 10.
Figure 12:
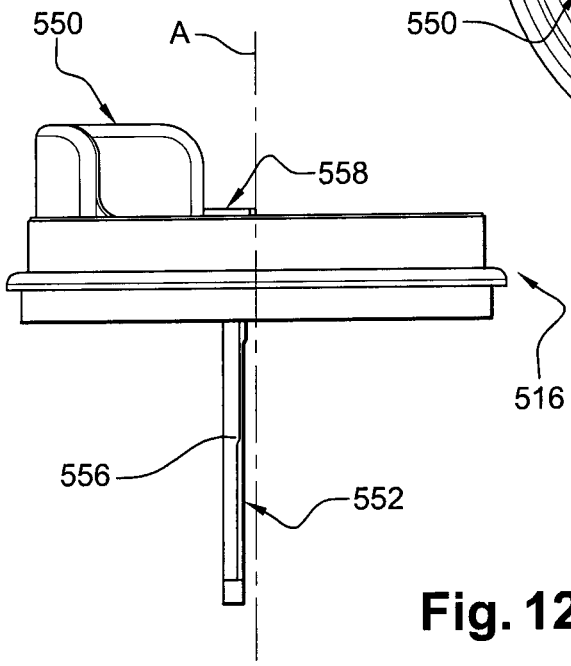
FIG. 12 is a diagrammatic side view of the plate of FIG. 10.

In the variation shown in FIGS. 10 to 12, the receptacle of the packaging item is not shown and is similar to those shown in FIGS. 1 to 6. The plate 516 of this packaging item includes, in addition to the wiping member 518, a handle or gripping means 550 for gripping the plate. In the depicted example, the handle extends outside the receptacle to facilitate displacement in rotation of the plate about the axis A of the opening of the receptacle. Scraper 552 extends into the receptacle and is configured to scrape the base of the receptacle and accumulate product in a withdrawal zone in the receptacle.

The plate 516 here carries two wiping members 518 disposed side by side. These wiping members may be identical or different.

The handle 550 is formed on the upper face of the plate 516 and is generally L-shaped, wherein a first portion extends substantially radially with respect to the axis A and is connected at its radially outer end to a second portion which extends over a portion of the periphery of the plate.

The plate 516 may be displaced in rotation on the receptacle about the axis A in the direction of the arrow 554.

The scraper 552 of the plate 516 typically is a substantially planar plate 556 which is parallel to the axis A, and extends into the receptacle from its upper end connected to the lower face of the plate. The lower free end of the scraper 552 is intended to sweep or scrape the base of the receptacle to recover product remaining at the base of the receptacle and to collect it in a withdrawal zone in the receptacle. This plate typically includes two parallel faces, the wiping members 518 being disposed on the plate such that the lower ends of the wiping members open beside one of these faces. When the plate 516 is displaced on the receptacle in the direction of the arrow 554, a portion of the product remaining at the base of the receptacle accumulates on the face of the plate 556, facilitating removal of the product using an applicator.

The plate 516 also typically includes marks 558 formed in relief on the upper face and indicating a recommended angle for displacement of the plate on the receptacle, for a sufficient quantity of product to be accumulated on the plate. The plate 516 may be held in a given angular position about the axis A for a predetermined period (for example 7 days) and be displaced by an angle defined by the marks 558 at the end of this period. The handle 550, the plate 556 and the marks 558 may be formed as a single piece with the plate 516 or be attached and fixed thereto.

In yet another variation, not shown, the shape of the plate of the packaging item may be other than circular or elongate, for example in the shape of a Y, X, C, O, etc.

Obviously, numerous modifications and variations of the present invention are possible in light of the above teachings. It is therefore to be understood that within the scope of the appended claims, the invention may be practiced otherwise than as specifically described therein.

The invention claimed is:

1. A packaging item for a cosmetic product, the packaging item comprising:

a receptacle including a neck which defines an opening; and a plate extending along the opening of the receptacle and supporting a plurality of wiping members configured to permit passage of an applicator to remove the product from the receptacle, said applicator comprising a tip configured to remove product from the receptacle via insertion of said tip into one of the plurality of wiping members, wherein said tip is configured to be wiped by said wiping member when the applicator is withdrawn from said wiping member, wherein the plate is movably mounted on the receptacle such that at least two wiping members of the plurality of wiping members are configured to occupy different positions in the opening of the receptacle, the positions allowing the product to be removed with the applicator from different zones of the receptacle, wherein said packaging item includes means for guiding in rotation or in translation the plate which surrounds the neck of the receptacle, the means for guiding including an inner protruding bead which is engaged by elastic snap-filling in an outer groove of the neck and which is configured to slide in the outer groove of the neck.

2. The packaging item as claimed in claim 1, wherein the plate is movable on the receptacle in a plane which is substantially perpendicular to an axis (A) of the opening of the receptacle.

3. The packaging item as claimed in claim 1, wherein displacement of the plate on the receptacle causes a displacement of the wiping members in the opening of the receptacle via at least one of rotation or translation.

4. The packaging item as claimed in claim 3, wherein trajectories of the displacement of the wiping members in the opening of the receptacle are non-secant.

5. The packaging item as claimed in claim 1, wherein the plate is rotatable on the receptacle about an axis parallel to an axis (A) of the opening, or rotatable about the axis (A).

6. The packaging item as claimed in claim 5, wherein the wiping members are disposed at radial distances R1, R2, and R3, respectively, from the axis (A) of rotation of the plate, and the radial distances RI, R2, and R3 are different from each other.

7. The packaging item as claimed in claim 1, wherein a sum of dimensions in a transverse direction of the wiping members represents between approximately 30% and 100% of a dimension in the transverse direction of the opening of the receptacle.

8. The packaging item as claimed in claim 7, wherein the sum of dimensions in the transverse direction of the wiping members represents between approximately 45% and 50% of the dimension in the transverse direction of the opening of the receptacle.

9. The packaging item as claimed in claim 1, wherein the number of wiping members is from two to ten.

10. The packaging item as claimed in claim 9, wherein the number of wiping members is from three to six.

11. The packaging item as claimed in claim 1, wherein the plate includes one of a circular, square, or rectangular outer contour.

12. The packaging item as claimed in claim 1, wherein the plate covers at least a portion of the opening of the receptacle.

13. A packaging item for a cosmetic product, the packaging item comprising:

a receptacle including a neck which defines an opening; and a plate extending along the opening of the receptacle and supporting a plurality of wiping members configured to permit passage of an applicator to remove the product from the receptacle; and said applicator comprising a tip configured to remove product from the receptacle via insertion of said tip into one of the plurality of wiping members, wherein said tip is configured to be wiped by said wiping member when the applicator is withdrawn from said wiping member, means for moving at least two wiping members of the plurality of wiping members to occupy different positions in the opening of the receptacle, the positions allowing the product to be removed with the applicator from different zones of the receptacle, wherein said packaging item includes means for guiding in rotation or in translation the plate which surrounds the neck of the receptacle, the means for guiding including an inner protruding bead which is engaged by elastic snap-filling in an outer groove of the neck and which is configured to slide in the outer groove of the neck.

14. The packaging item as claimed in claim 13, wherein the means for moving provide displacement of the wiping members in the opening of the receptacle via at least one of rotation or translation.

* * * * *